US005511746A

United States Patent [19]

Hostetter

[11] Patent Number: 5,511,746

[45] Date of Patent: Apr. 30, 1996

[54] CONVERTING WRIST TO FINGER KITE HANDLE

[75] Inventor: Todd Hostetter, Seattle, Wash.

[73] Assignee: Kathy Goodwind, Seattle, Wash.

[21] Appl. No.: 300,228

[22] Filed: Sep. 6, 1994

[51] Int. Cl.[6] ..... A63H 27/04; A63H 27/08

[52] U.S. Cl. ..... 244/155 A; 244/155 R; 446/31

[58] Field of Search ..... 16/110 R, 125, 16/126; 446/30, 31, 65; 244/153 R, 155 R, 155 A

[56] References Cited

U.S. PATENT DOCUMENTS

| | | | |
|---|---|---|---|
| 987,963 | 3/1911 | Craig | 244/153 R |
| 2,947,108 | 8/1960 | Dodd, Jr. et al. | 446/30 |
| 3,375,605 | 4/1968 | Gallagher | 446/31 |
| 3,873,051 | 3/1975 | Kennedy | 244/155 R |
| 5,120,081 | 6/1992 | Longoria et al. | 244/155 A |

OTHER PUBLICATIONS

"Peter Powell Kites", *Kite Lines* vol. 7, No. 1 Spring 1988, p. 21.

"Good Grips" *Kite Lines* vol. 8 No. 1 Summer 1990, p. 67.

*Primary Examiner*—Andres Kashnikow
*Assistant Examiner*—Virna Lissi Mojica
*Attorney, Agent, or Firm*—Joseph Chalverus

[57] ABSTRACT

A convertible wrist to finger kite handle constructed in the manner of a wrist kite handle of flexible material having a wrist loop and kite string attachment ring, the invention incorporating a conversion ring adjacent to the attachment ring to permit the flexible material of the wrist loop to be introduced therein to convert the single wrist loop into a two finger kite handle. The invention also contemplates the incorporation of additional conversion rings adjacent to each other to provide for a three and four finger kite handle.

14 Claims, 3 Drawing Sheets

CONVERTING WRIST TO FINGER KITE HANDLE

BACKGROUND OF THE INVENTION

1. Field of the Invention

The present invention generally relates to kite flying accessories and, more specifically, is concerned with apparatus used to hold kite lines such as kite line handles. More particularly this invention relates to a kite handle which is adapted to convert the handle from a wrist kite hand to a finger kite handle and back to a wrist handle.

2. Description of the Related Art

A kite can be described as a passive object which is lifted into the air using the dynamic forces created by a moving air mass or air currents. In order to fly the kite must have the basic elements of flying, such as a lift means and a drag means. Further, to maintain the kite in a relative position with respect to the person flying the kite, the kite also has a means to hold or retain the kite. The means to retain the kite typically is a cord or string tied to the kite on one end and held by the kite flyer on the other end.

Within the last few years the science of kite flying has gained great strides by improving performance in terms of design of the structure and use of materials which are particularly adaptable for kites. For example, kites are now often attached by two or more lines enabling improved control over the kite, to covert a mere passive device which is lifted into the air, to a performing and entertaining device. Kite flying is now a sport which is now enjoyed by people of many nations, engaging many persons in contests and display events. Kite flying has even developed into a team sport, offering competitive challenge as well as personal enjoyment with audiences.

Because kites have developed and improved in the many ways to meet the ever-changing needs of kite flyers, cloth paper covers have given way to sophisticated membranes designed specifically for the forces and stresses encountered during flying. Exotic composites of reinforced graphic and resin members have gained acceptance as superior alternative to old fashion wooden spars.

New techniques have also been developed to control and hold kites. In addition to kites having one line to hold the kite, there are now kites having two lines and even experimental kites with multiple lines which are gaining more and more acceptance. The additional lines have made kite flying more versatile and enjoyable than ever before. Kite flyers now do more than merely extend the kite upward to the mercy of the wind but control the speed and aspect of the kite to the wind to permit controlled flights in light or strong winds constrained only by the lines attaching the kite to the flyer.

Kite flyers can achieve sensitive positioning of the kites, to attach cameras for aerial photography and surveillance, drop parachutes for deliveries, extent lines across broad rivers or between boats at sea, etc. Flyers also quickly maneuver their kites for aerobatics contests and precision performance exercises to be enjoyed by all.

As kites have become more efficient and lighter the tug or pull of the kite line becomes stronger, the kites exert increasing stronger pull so that the old line on the spool is no longer sufficient to comfortable hold the kite. Natural fiber lines have given way to synthetic poly-filament kite lines having many times the strength of the former lines and twines of the past. These new kite lines not only resist the increased strain without excessive stretching or breaking but last longer and without the wear of the string which was adapted for the use of kite flying of the past.

These improvements coupled with the increased forces of the kite line have made kite string handles more and more popular as a device to hold the kite line while minimizing fatigue. Kite handles prevent the line from burning the hand in an unexpected gust. Kite handles also allow the kite flyer to exert better control over kites generating increased pull when needed. The kite handle attaches to one end of a predetermined length of kite line while the kite is attached to the other end of the line. To fly the kite, the line is unfolded either before the flight or carefully during the flight. As the kite rises the line unfolds until all the line is out. The kite handle is then available for controlling the kite for which it is designed.

There are now two standard configured kite handles: The first is known as the wrist strap and the other the finger strap. The wrist kite handle comprises one main strap of strong, flexible material such as braided "nylon" strip of about one inch in width sewn at its ends to form a hand strap or closed band sufficiently sized to insert a hand. The ends of the strip which form the band are sewn together and secured by a kite line attachment ring for securing the kite line. The kite line attachment ring is often a fiberglass or metal, circular, semi-circular or configured into a triangular piece to facilitate quick attachment of the kite line. The kite line of the particular kite can then be attached to the kite line attachment ring.

Once in place the wrist kite handle is simple to use: the kite line is unfolded and the hand is inserted through the opening of the strap or closed band so that the strip of material forming the band rests upon the back portion of the wrist enabling the hand to grasp the portion of the strap which emerges between the forefinger and thumb. This allows the kite flyer to firmly grasp the part of the strap which emerges from within the thumb and forefinger with his fingers while the main pull of the kite is held by the wrist and lower arms. In this way the strength of the pull of the kite can avoid the limitations of strength of hands and fingers which are generally weaker than the wrist and arm muscles. This prevents the line from slipping through the kite flyer's hand, possibly burning or cutting his hand or even loosing a valuable kite to the forces of the wind and nature and enables the flying of larger kites with larger pull, either because of the kite's size or because of the wind conditions.

In summary, the wrist kite handle provides convenient, strong, reassuring control for kite flying, ideal when a considerable amount of pull is expected such as when flying large kites or kites in high winds.

The other kite handle which is becoming popular is called the finger kite handle. The kite handle is made from a strong, flexible material such as braided "nylon" strap of about one inch in width sewn together to form two or more finger loops, small straps or closed bands sized to insert fingers. The ends of the finger loops are secured by a kite line ring to hold the kite string as is the wrist kite handle. As in the wrist kite handle, the loop is often a fiberglass or metal circular or configured triangular piece to facilitate quick attachment of the kite line. Once in place the finger kite handle is simple in its use: the kite line is unfolded and fingers are inserted into the finger loops. In this way the pull of the kite is controlled by the movement of the fingers which are generally more sensitive than the wrist and arm muscles and enable the user to exert more control over the kite by detecting changes in the pull of the kite thereby exerting more precise control over the kite. This system provides sensitive but secure control for flying kites when considerable pull is not expected. An additional advantage of the finger kite handle is that the kite flyer's wrist is less likely to fatigue.

While the wrist kite handle and the finger kite handle are both fine handles for controlling a kite, each has an inherent limitation and each handle is best used as designed. A wrist kite handle does not work very well as a finger kite handle since there is no security for the fingers within a very large strap. Likewise, the finger kite handle does not work at all as a wrist strap since the finger loops must necessarily be sized approximately to the fingers. This necessitates a person who wishes to fly a modern kite taking advantage of the technology of kite handles to keep at ready both type of handles for maximum comfort and enjoyment, to use the wrist kite handle when appropriate, or if wind conditions change to remove the kite from the wrist kite handle and attach it to a finger kite handle.

Additionally, present finger kite handles are not adjustable such that the relative size and position of the finger loops are fixed. This means less than ideal comfort and control for the kite flyer with a finger kite handle not proportionately sized to the flyer's fingers. In order for standard finger kite handles be used by a majority of the persons, the finger loops must be sized larger than what would normally be the finger loop size to accommodate the persons with larger size fingers.

Consequently, a need exists for a kite handle which serves as a wrist kite handle for part of the time but can convert to a finger kite handle for the other part of the time and vice versa. There also exists a need for a kite handle which when serving as a finger kite handle allows for adjusting the size, number, and proportionality of the size of the finger loops of the handle.

SUMMARY OF THE INVENTION

It is an object of this invention to provide a wrist kite handle which can be easily and simply converted into a finger kite handle and back again into a wrist kite handle.

Another object of this invention is to provide a finger kite handle which adjusts for the size, and relative position of the finger loops of the kite flyer.

A further object of this invention is to provide a convertible wrist to finger kite handle using a single conversion means or ring to convert the handle from a wrist handle to a finger kite handle.

An additional object of my invention is to provide a convertible wrist to finger kite handle which can convert to an adjustable number of finger loops of various proportions of size of the user's fingers.

Briefly, the invention allows a kite handle to be transformed between wrist handle to the finger handle and thereby eliminate the need to untie and then retie a kite string from one kite handle to another kite handle. While the converting kite handle is in finger handle configuration, the size and relative position of the finger loops are easily adjusted in proportion to each loop to the other. My invention also contemplates that the number of finger loops is a function of the number of conversion rings used in the particular embodiment of the invention. Also, the invention allows a single band of flexible material such as braided "nylon" strip formed into a hand size strap or band, a the wrist kite handle in one configuration and the finger loops when in the other or finger kite handle configuration.

The invention includes one or more conversion rings made part of the braided strap. The kite flyer anchors the invention to his wrist by inserting his hand through the strap or band of letting the strip rest against the back of the hand with the finger grasping the strip as it exits from the hand through the thumb and fore finger. The kite line attaches to the attachment ring also made part of the braided strap, thereby anchoring the kite to the invention. The conversion ring serves to convert the wrist handle into finger loop handles when the braided strip is folded through the conversion ring. If one conversion ring is used, the wrist handle will fold into two distinct finger loops. The size and relative position of the two finger loops is a function of how much of the strap is passed through the conversion ring. If two conversion rings are incorporated then the wrist handle will form three distinct loops for the fingers. The size and relative position of the three finger loops is a function of how much of the strap is passed through the two conversion rings.

The conversion rings and attachment rings may be made of any appropriately strong material such as metal or plastic but they can also be made of flexible material such as "nylon" braid of the same kind of braiding strip used for the handle.

Although the present invention has been described with reference to preferred embodiments, numerous modifications and rearrangements can be made, and still the result will come within the scope of the invention.

DESCRIPTION OF THE PREFERRED EMBODIMENTS

Figure 1:
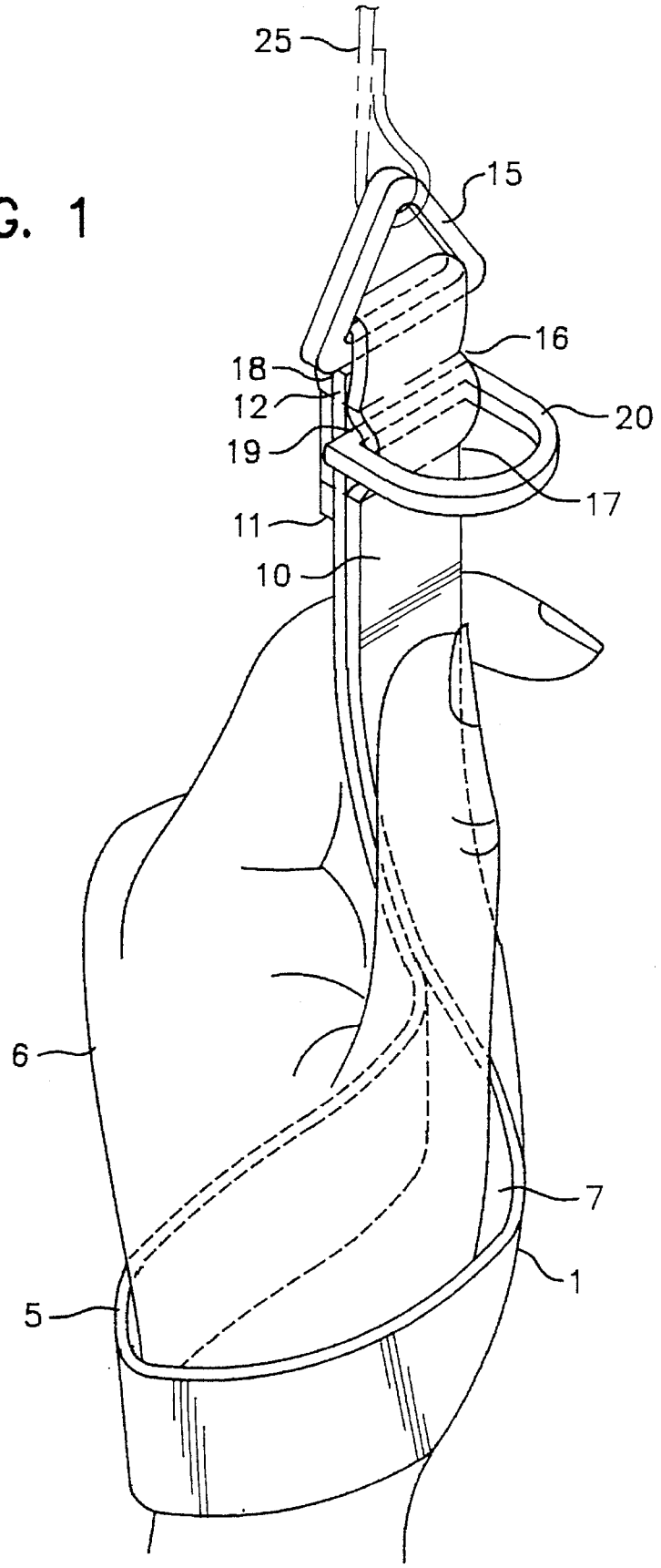
FIG. 1 is a perspective view of a preferred embodiment of the convertible wrist to finger kite handle in the wrist handle configuration.

Referring now to the drawings, and more particularly to FIG. 1, there is shown apparatus for converting a wrist kite handle to a finger kite handle. The converting wrist to finger handle kite 1 is portrayed by solid lines in the wrist configuration. The flexible hand strap or closed-loop wrist handle 5 as held by the flyer's hand 6 is inserted through the large opening 7 of the strap or wrist handle. The converting wrist to finger kite handle is constructed in the manner similar to the wrist kite handle but with the incorporation of one or more converting rings as will be detailed below. A strip of "NYLON" braid 10 or other material having the properties of being flexible, strong and lending itself to be easily sewn and cut is used. The braid may be composed of different color threads (not shown) to lend itself attractive and interesting. As in the wrist kite, the Braid 10 can be of any convenient width which would distribute forces over an area of the wrist and hand of the flyer. The length of the braid before it is sewn into a strap or closed band of the braided strip should be long enough so that the resulting opening 7 is large enough to permit a hand 6 to be introduced. A typical width of the braid would be about one inch. A typical length of the braid would be about twenty one inches, leaving a wrist opening 7 of about six inches in diameter after it is trimmed and sewn together. Obviously, a shorter or longer length of braid or a narrower or wider braid would also be useful for constructing this apparatus, the actual length and width of the material being dependant as well upon availability and price of the flexible material.

Figure 3:
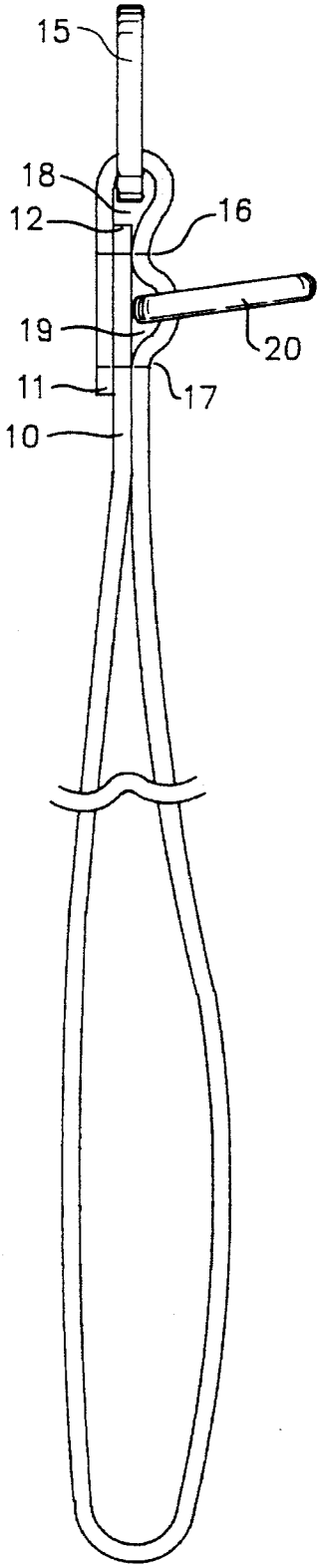
FIG. 3 is a side elevation view of a preferred embodiment of the convertible wrist to finger kite handle in the wrist handle configuration.

The braid 10 is sewn with one end 11 of the braid folded to overlap the other end 12 of the braid in the manner shown in FIG. 1. This creates a crease 18 in the material. A triangular shaped attachment ring 15 is sewn into the crease 18 located approximately one inch from one end 11 of the braid. A semicircular shaped conversion ring 20 is also sewn into the braid, next to the attachment ring. Both pieces can be sewn into the braid by two seams 16 and 17. The seams 16 and 17 are adjecent to but spaced from each other to permit the attachment ring 15 and conversion ring 20 to rotate within the creases 18 and 19 constructed by folding the material around the ring and then sewing the seams 16 and 17. Since FIG. 1 and FIG. 3 show the converting wrist to finger kite handle 1, the conversion ring 20 is seen without any apparent use. The conversion ring 20 while describe here as semicircular need not be semicircular, but could have other shapes, such as circular or rectangular. Unlike the attachment means, however, a triangular configuration would not be very useful since the strap which will fold by the ring will fold within a point within the triangular ring causing it to fold upon itself. Further, the conversion ring and the attachment ring need not be rigid, but may be flexible as is the braided material used for the strap or even thiner than the braid used for the strap. As with the attachment ring 15, the width of the portion of the conversion ring sewn withing the crease formed by folding the material upon inself then sewing the folded material to form the void 18 should be sufficient to permit the braid to be sewn without doubling. Further, the portion of the conversion ring 20 remaining outside the braid 10 should have sufficient width to permit the braid 10 to be introduced without the braid 10 folding.

Figure 2:
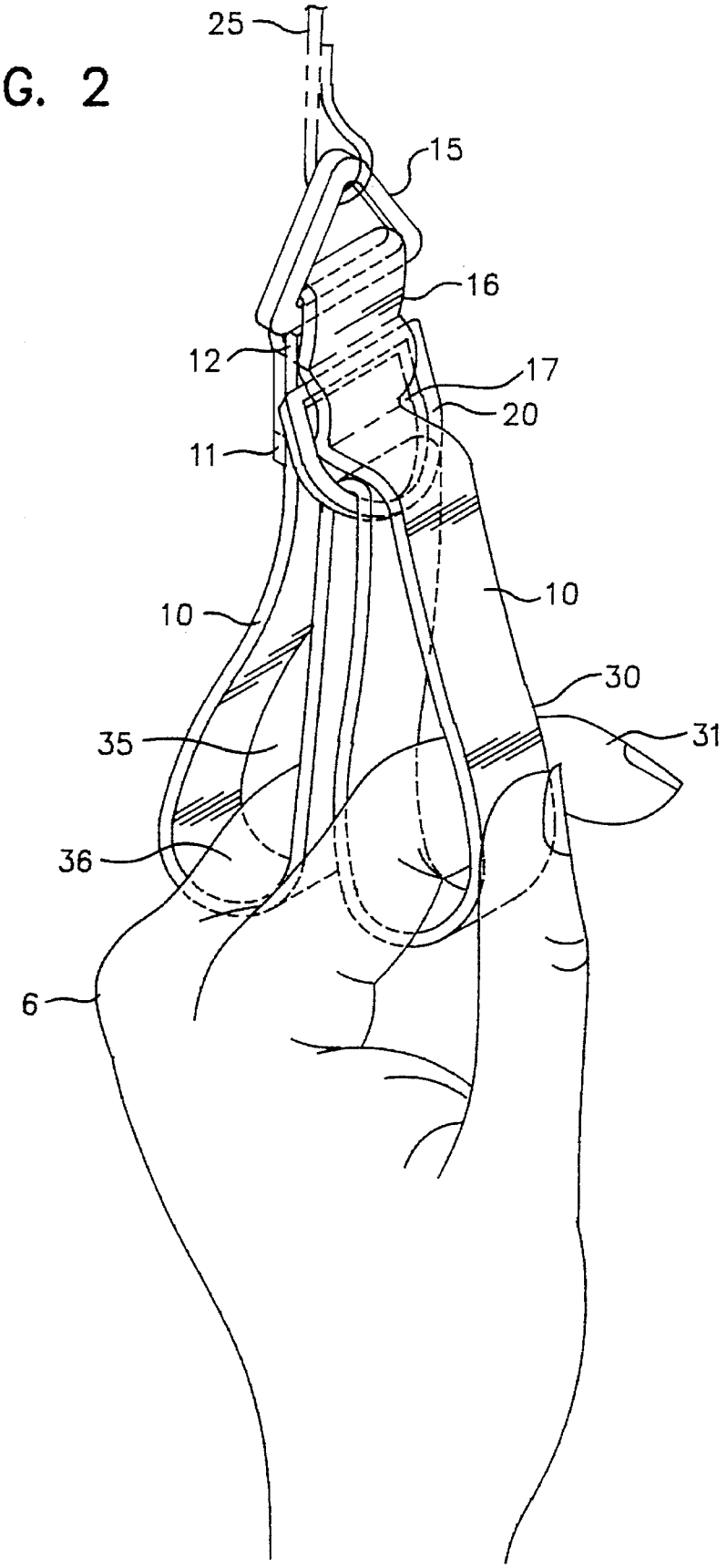
FIG. 2 is a perspective view of a preferred embodiment of the convertible wrist to finger kite handle in the finger handle configuration.

FIG. 2 shows the use of conversion ring 20. When the user wishes to convert the apparatus from a wrist kite handle configuration to a finger kite handle configuration, the user removes the hand 6 from the strap or wrist opening 7, then a portion of the braid 10 is lead into the opening of the conversion ring 20, forming a finger loop 30 by decreasing the size of the strap or wrist opening 7. In FIG. 2 the decreased wrist opening is shown as a finger loop 35. By this simple manipulation, the converting wrist to finger kite handle changes the wrist kite handle configuration to a two finger kite handle configuration enabling the kite flyer, without disengaging the kite string 25 from the kite handle 1 to fly the kite as a finger kite handle. In this other configuration the kite flyer may now control the kite by use of his or her fingers instead of the hand as shown in FIG. 1. FIG. 2 shows the user's middle finger introduced through finger loop 35 and shows the user's forefinger 31 introduced through finger loop 30. It is noted that all of the features in FIG. 1 are also present in FIG. 2 except for the positioning of the braid 10 through the conversion ring 20 and the manner in which the fingers 31 and 36 hold the kite handle instead of the hand 6.

The attachment ring 15 and the conversion rings 20, 21 and 22 may be made of rigid or flexible material such as metal or any strong material able to resist the pull of the kite (not shown) even in the strongest winds. In my embodiment both the attachment ring and the conversion rings are constructed of "nylon", having a width sized to permit the introduction of the braid 10 without the braid folding upon itself. Since the kite string 25 is tied to the attachment ring 15 as shown in FIG. 1, the triangular configuration of the attachment ring 15 is most appropriate, however, circular, rectangular or other configurations as equally adaptable for the purposes described herein.

My invention is not limited to a wrist handle which converts to only a two finger kite handle as shown in FIGS. 1, 2 and 3. By sewing a second conversion ring 21 adjecent to the conversion ring 20 by folding the material to create a crease 28 with a third seam 23 the wrist handle 1 can be converted to a three finger configuration. In this way, the kite flyer could convert the kite handle 1 into either a two finger kite handle as shown in FIGS. 1, 2 and 3 or into a three finger kite handle (not shown) to permit the ring finger (not shown) to be introduced into a third finger loop 40, shown in FIG. 4 as the alternate configuration with broken lines. The third finger loop 40 is the result of introducing the braid into the second conversion ring 21 in the same manner as the user introduces the braid into the conversion ring 20 so that the forefinger 31 shown in FIG. 2 occupies finger loop 30 shown in FIG. 4 as a broken line, middle finger 36 shown in FIG. 2 occupies finger loop 35 shown in FIG. 4 with a broken line and ring finger (not shown) occupies finger loop 40, shown in FIG. 4 with a broken line.

Figure 4:
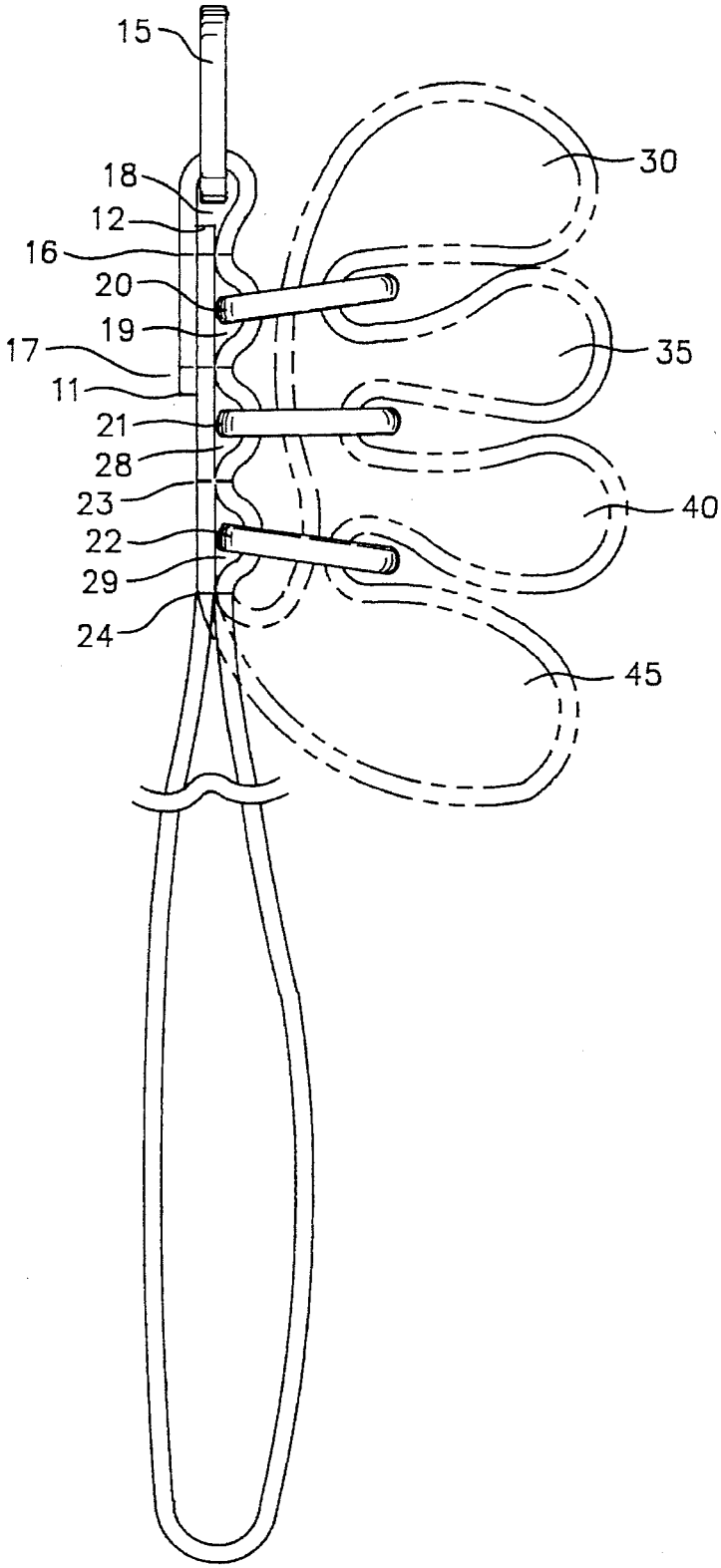
FIG. 4 is a side elevation view of an alternate embodiment of the convertible wrist to finger kite handle, showing a four finger version with a broken line view as the alternate finger handle configuration to the wrist handle configuration shown in solid lines.

FIG. 4 also teaches how a converting kite handle can be made into a four finger kite. By sewing a third conversion ring 22 adjecent to the conversion ring 21 by folding the material to create a crease 29 with a fourth seam 24. In this way, the wrist handle 1 could convert the kite handle 1 into either a two finger kite handle as shown in FIGS. 2 and 3 or into a three finger kite handle (not shown) or a four finger kite handle as shown in FIG. 4.

The forth finger loop 45 is the result of introducing into the braid a third conversion ring 22 in the same manner as the user introduces into the braid the conversion rings 20 and 21 so that the forefinger 31 occupies finger loop 30, middle finger 36 occupies finger loop 35, ring finger (not shown) occupies finger loop 40 as shown in FIG. 4 as a broken line and the little finger (not shown) occupies finger loop 45 as shown in FIG. 4 as a broken line.

In any of these configurations, the relative size of the loops for the fingers can be adjusted by the kite flyer according to the size of his or her fingers, the strength of the wind, pull and control which the kite flyer wishes to have over the kite.

It is thought that the convertible wrist to finger kite handle apparatus of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What I claim is:

1. A converting wrist to finger kite handle comprising:

a strip of flexible material formed into a band with an opening sized for a hand;

a kite string attachment means integral to said flexible strip;

a conversion means permitting said material to be formed into a plurality of loops, said conversion means attached to the strip, separate from and adjacent to said kite string attachment means.

2. A converting wrist to finger kite handle as described in claim 1 wherein said kite string attachment means is a ring sewn into a crease created by folding said material.

3. A converting wrist to finger kite handle as described in claim 2 wherein said conversion means comprises a plurality of rings, each ring sewn within its own crease created by folding said flexible material adjecent to each other, each ring sized to permit a portion of the strip to be introduced through the rings forming a plurality of loops sized for fingers from said strip.

4. A converting wrist to finger kite handle as described in claim 1 wherein said conversion means comprises a ring sewn within a crease created by folding said flexible material sized to permit a portion of the strip to be introduced through the ring forming two loops sized for fingers from said strip.

5. A converting wrist to finger kite handle as described in claim 1 wherein said conversion means comprises two rings sewn within creases created by folding said flexible material adjecent to each other, each ring sized to permit a portion of the strip to be introduced through the rings forming three loops sized for fingers from said strip.

6. A converting wrist to finger kite handle as described in claim 1 wherein said conversion means comprises three rings sewn within creases created by folding said flexible material adjecent to each other, each ring sized to permit a portion of the strip to be introduced through the rings forming four loops sized for fingers from said strip.

7. A converting wrist to finger kite handle as described in claim 1 wherein said strip of flexible material is a strip of "NYLON" braid.

8. A converting wrist to finger kite handle as described in claim 2 wherein the shape of said ring is triangular, a leg of which is sewn into creases created by said folding of the material.

9. A converting wrist to finger kite handle as described in claim 3 wherein the shape of said conversion ring is semicircular, the straight leg of which is sewn within said crease created by folding said flexible material.

10. An improved kite handle having a closed strap made of flexible material sized for a hand and a kite string attachment means integral to the flexible material, the improvement comprising:

a conversion means separate from and adjacent to said kite string attachment means permitting said material to be formed into a plurality of loops, each loop sized for a finger converting said kite handle into a kite handle having finger loops. into a kite handle having finger loops.

11. An improved kite handle as described in claim 10 wherein said conversion means comprises a plurality of rings, each ring sewn within creases created by folding the flexible material adjecent to each other, each ring sized to permit a portion of the strip to be introduced through the rings forming a plurality of loops sized for fingers from said strip.

12. An improved kite handle as described in claim 10 wherein said conversion means comprises a ring sewn within a crease created by folding the flexible material, sized to permit a portion of the strip to be introduced through the ring forming two loops sized for fingers from said strip.

13. An improved kite handle as described in claim 10 wherein said conversion means comprises two rings, each ring sewn within creases created by folding the flexible material adjecent to each other, each ring sized to permit a portion of the strip to be introduced through the rings forming three loops sized for fingers from said strip.

14. An improved kite handle as described in claim 10 wherein said conversion means comprises three rings, each ring sewn within creases created by folding the flexible material adjacent to each other, each ring sized to permit a portion of the strip to be introduced through the rings forming four loops sized for fingers from said strip.

* * * * *